US011402793B2

(12) United States Patent
Saitou et al.

(10) Patent No.: US 11,402,793 B2
(45) Date of Patent: Aug. 2, 2022

(54) ROTATING BODY, MEMBER TO BE INSERTED WITH SHAFT, RETAINING MEMBER, AND APPARATUS

(71) Applicants: Makoto Saitou, Ebina (JP); Naoki Okazaki, Ebina (JP)

(72) Inventors: Makoto Saitou, Ebina (JP); Naoki Okazaki, Ebina (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/294,812

(22) PCT Filed: Dec. 19, 2019

(86) PCT No.: PCT/JP2019/049888
§ 371 (c)(1),
(2) Date: May 18, 2021

(87) PCT Pub. No.: WO2020/145077
PCT Pub. Date: Jul. 16, 2020

(65) Prior Publication Data

US 2021/0397120 A1 Dec. 23, 2021

(30) Foreign Application Priority Data

Jan. 10, 2019 (JP) ..... JP2019-002269
Jan. 12, 2019 (JP) ..... JP2019-003914

(51) Int. Cl.
*G03G 21/16* (2006.01)
*G03G 15/00* (2006.01)

(52) U.S. Cl.
CPC ..... *G03G 21/1647* (2013.01); *G03G 15/6529* (2013.01); *G03G 2221/1654* (2013.01)

(58) Field of Classification Search
CPC ..... G03G 21/1647; G03G 15/6529; G03G 2221/1654
See application file for complete search history.

(56) References Cited

U.S. PATENT DOCUMENTS 6,072,968 A * 6/2000 Nomura ..... G03G 21/181 399/113
6,285,846 B1 * 9/2001 Suzuki ..... G03G 21/1685 399/122

(Continued)

FOREIGN PATENT DOCUMENTS

EP 0616140 A2 9/1994
EP 1233310 A2 8/2002

(Continued)

OTHER PUBLICATIONS

International Search Report dated Mar. 23, 2020 in PCT/JP2019/049888 filed on Dec. 19, 2019.

(Continued)

*Primary Examiner* — Sandra Brase
(74) *Attorney, Agent, or Firm* — Harness, Dickey & Pierce, P.L.C.

(57) ABSTRACT

A rotating body to be inserted with a shaft includes a holding portion on an end portion of the rotating body to hold the rotating body on the shaft. The holding portion includes a hook to be elastically deformable and detachably hook on a recess of an end portion of the shaft. The holding portion is rotatingly movable, with elastic deformation of the hook, over a convex portion of the shaft that is outside the recess in an axial direction of the shaft.

20 Claims, 21 Drawing Sheets

(56) References Cited

U.S. PATENT DOCUMENTS

| | | | | |
|---|---|---|---|---|
| 2002/0001072 | A1 | 1/2002 | Suzuki et al. | |
| 2015/0210489 | A1* | 7/2015 | Doshida | B65H 5/06 271/275 |
| 2018/0088517 | A1* | 3/2018 | Nemoto | G03G 21/1647 |
| 2018/0154964 | A1 | 6/2018 | Sim et al. | |

FOREIGN PATENT DOCUMENTS

| | | |
|---|---|---|
| JP | 11-227963 | 8/1999 |
| JP | 2014-122087 | 7/2014 |
| JP | 2015-140218 | 8/2015 |

OTHER PUBLICATIONS

Written Opinion dated Mar. 23, 2020 in PCT/JP2019/049888 filed on Dec. 19, 2019.

* cited by examiner

ROTATING BODY, MEMBER TO BE INSERTED WITH SHAFT, RETAINING MEMBER, AND APPARATUS

TECHNICAL FIELD

Embodiments of the present invention relate to a rotating body, a member to be inserted with a shaft, a retaining member, and an apparatus.

BACKGROUND ART

For example, as a sheet feeding roller for feeding a sheet material or the like, a rotating body may be detachably mounted on the outer periphery of a rotating shaft to enable replacement due to deterioration over time.

Conventionally, there is known a roller member in which a rotation shaft is inserted into an insertion hole of a roller portion and the roller portion is detachably mounted on the outer periphery of the rotation shaft. A recess is provided in a portion of the rotation shaft that extends out from one end side of the roller portion to the other end side of the roller portion through the insertion hole of the roller portion. A snap fit portion that elastically deforms extends out from the other end side of the roller portion outward in the axial direction. An engagement convex portion that engages the recess is provided in the snap fit portion. In a state in which the snap fit portion is elastically deformed in a direction opposite to a direction in which the snap fit portion extends out, the engagement convex portion of the snap fit portion is engaged with the recess of the rotating shaft. By the elastic restoring force of the snap fit portion, one end side of the roller portion is pressed by a positioning holding portion provided on the rotation shaft (JP-2015-140218-A).

CITATION LIST

Patent Literature

PTL 1: JP-2015-140218-A

SUMMARY OF INVENTION

Technical Problem

However, in the configuration disclosed in JP-2015-140218-A, to remove the roller portion from the shaft, the roller portion from needs to be removed from the shaft while maintaining a state in which the snap fit portion is radially expanded and the engagement convex portion is removed from the recess. Therefore, there is a problem in workability of attachment and detachment operations of the rotating body with respect to the shaft.

Solution to Problem

The present invention has been made in view of the above-described problem, and an object of the present invention is to enhance the workability of the attachment and detachment operations of the rotating body with respect to the shaft.

In order to solve the above-describe problem, a rotating body to be inserted with a shaft includes a holding portion on an end portion of the rotating body to hold the rotating body on the shaft. The holding portion includes a hook to be elastically deformable and detachably hook on a recess of an end portion of the shaft. The holding portion is rotatingly movable, with elastic deformation of the hook, over a convex portion of the shaft that is outside the recess in an axial direction of the shaft.

Advantageous Effects of Invention

According to the present invention, the workability can be enhanced of attachment and detachment operations of the rotating body with respect to the shaft.

DESCRIPTION OF EMBODIMENTS

Figure 1:
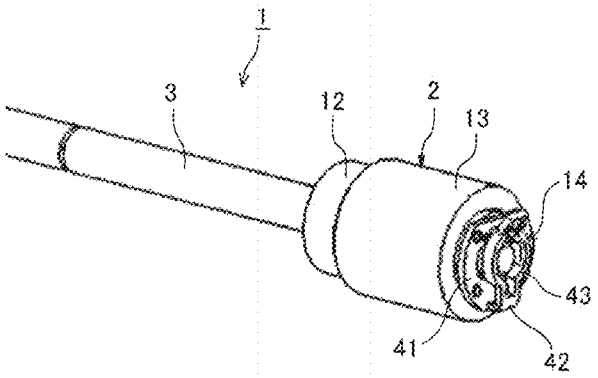
FIG. 1 is a perspective view of a rotating member in which a shaft is inserted into a rotating body, according to a first embodiment of the present invention.
Figure 2:
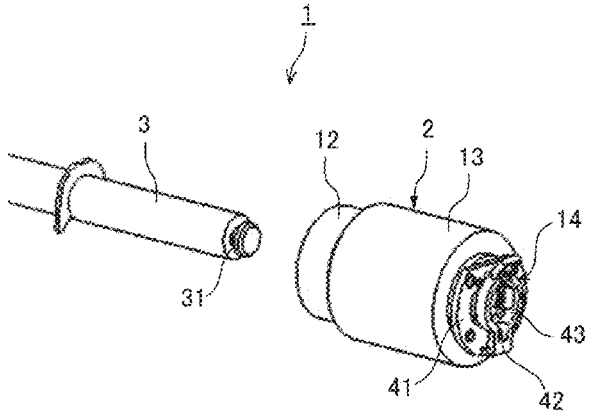
FIG. 2 is an exploded perspective view of the rotating member.
Figure 3:
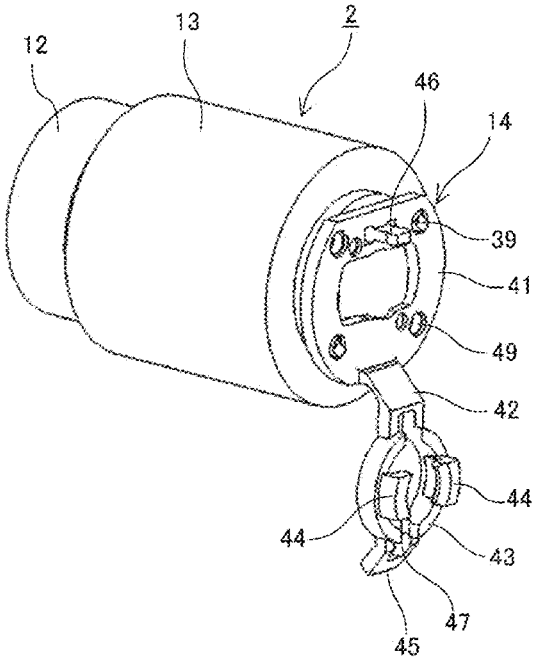
FIG. 3 is a perspective view of the rotating body that is a member to be inserted with the shaft of the rotating member.
Figure 4:
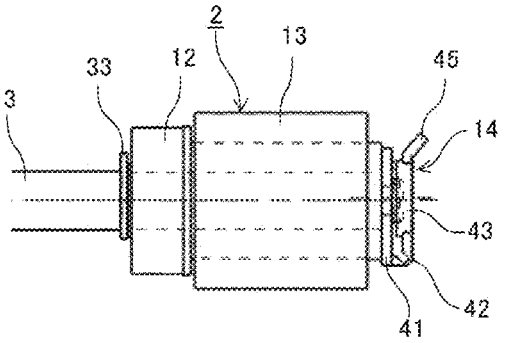
FIG. 4 is a side view of the rotating member.
Figure 5:
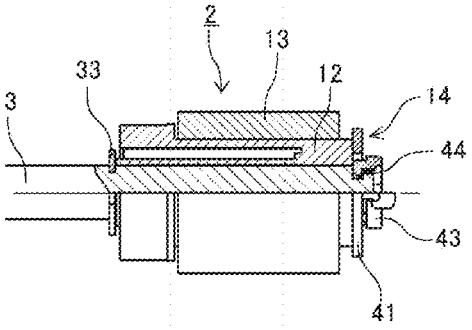
FIG. 5 is a cross-sectional view of the rotating member.
Figure 6:
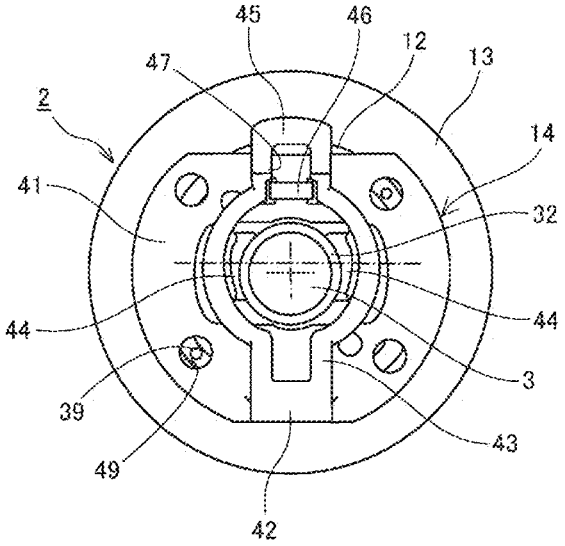
FIG. 6 is a front view of the rotating body.
Figure 7A:
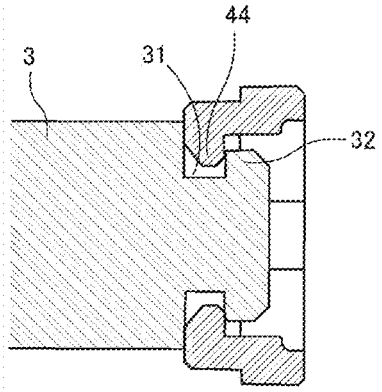
FIGS. 7A and 7B (FIG. 7) are enlarged views of an engagement portion between a recess and hooks of the rotating member.
Figure 7B:
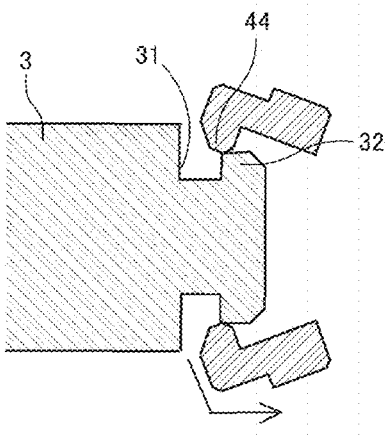

Below, a description is given of embodiments of the present invention with reference to the accompanying drawings. A first embodiment of the present invention is described with reference to FIGS. 1 to 7. FIG. 1 is a perspective view of a rotating member according to the first embodiment in which a shaft is inserted into a rotating body. FIG. 2 is an exploded perspective view of the rotating member. FIG. 3 is a perspective view of the rotating body that is a member to be inserted with the shaft of the rotating member. FIG. 4 is a side view of the rotating member. FIG. 5 is a cross-sectional view of the rotating member. FIG. 6 is a front view of the rotating member. FIGS. 7A and 7B are enlarged views of an engagement portion between a recess and hooks of the rotating member.

A rotating member 1 includes a rotating body 2 and a shaft 3 inserted into the rotating body 2.

The rotating body 2 includes a roller holding portion 12, a roller portion 13, and a holder portion 14. The roller holding portion 12 is a hollow member into which the shaft 3 is inserted. The roller portion 13 is formed of rubber that is an outer peripheral member that is press-fitted into the hollow member. The holder portion 14 includes a holding portion and is a retaining member according to an embodiment of the present invention. The rotating body 2 is held at an end of the shaft 3 by a stopper portion 33 of the shaft 3 and the holder portion 14.

The holder portion 14 includes an attachment portion 41 and a snap fit portion 43. The attachment portion 41 is fixed to a surface of the roller holding portion 12 by adhesion, heat caulking, ultrasonic welding, or the like. The snap fit portion 43 is a holding portion (a retaining portion) that is rotatably held with respect to the attachment portion 41 via a hinge 42.

The snap fit portion 43 has two hooks 44 that can be elastically deformed in the radial direction of the shaft 3 and can be engaged with a recess 31, which is formed at the end of the shaft 3, from the radial direction of the shaft 3. The hooks 44 have a claw shape. The hooks 44 of the snap fit portion 43 are hooked on the recess 31 of the shaft 3 to hold the rotating body 2 at the end of the shaft 3.

Here, as illustrated in FIGS. 7A and 7B, the snap fit portion 43 is rotatably held with respect to the attachment portion 41 (an end of the rotating body 2) via the hinge 42 so that the hooks 44 move over a wall portion 32 on the outer side from the recess 31 in the axial direction and move outward in the axial direction. The wall portion 32 has a larger diameter than the recess 31 and is a convex portion protruding beyond the recess 31 in the radial direction of the shaft 3.

The snap fit portion 43 is provided with a knob 45 as an operation portion on the opposite side of the hinge 42 serving as a rotation fulcrum, with the hooks 44 interposed between the hinge 42 and the knob 45.

As illustrated in FIG. 4, the knob 45 is formed obliquely in a direction away from the end face of the rotating body 2. Moreover, the knob 45 may be different in color from other parts, thus allowing the operation method to be indicated in an easy-to-understand manner for the user. The coloring method may be performed by printing, decal pasting, two-color molding, or the like.

The attachment portion 41 is provided with a hook 46 that is a locking portion on the opposite side of the hinge 42. A locking hole portion 47 to be locked by the hook 46 is provided in the vicinity of the knob 45 in the snap fit portion 43. In a posture in which the hooks 44 of the snap fit portion 43 are engaged with the recess 31 of the shaft 3, the hook 46 is fitted and locked in the locking hole portion 47 of the snap fit portion 43.

The roller holding portion 12 of the rotating body 2 is provided with projections 39 to position the holder portion 14 in the radial direction. On the other hand, the attachment portion 41 of the holder portion 14 is provided with a plurality of holes 49 into which the projections 39 of the roller holding portion 12 are fitted. As the plurality of holes 49, the attachment portion 41 has holes that are different in hole diameters and distance between the holes, thus allowing the attachment portion 41 to be attached to various types of the roller holding portions 12 while being positioned.

Figure 8A:
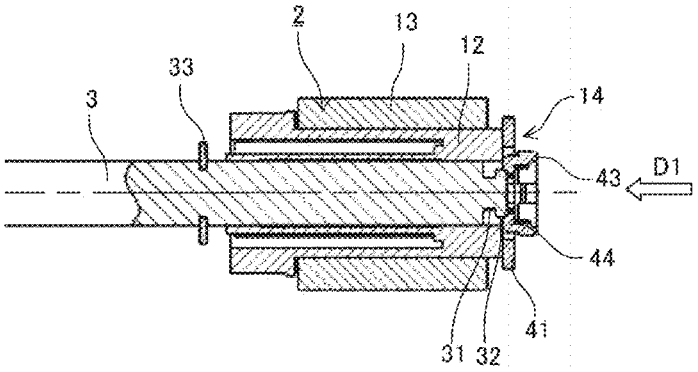
FIGS. 8A and 8B (FIG. 8) are cross-sectional views of a process of inserting the shaft into the rotating body.
Figure 8B:
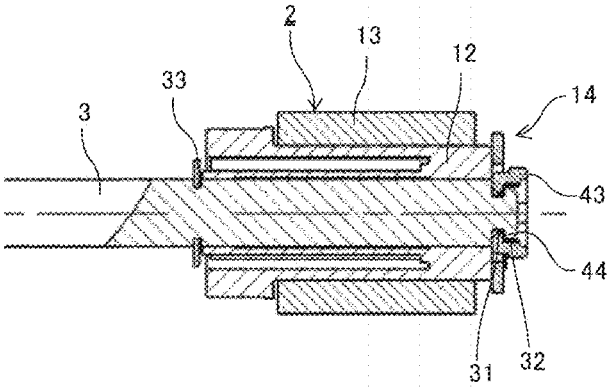

Next, an operation in mounting the rotating body 2 on the shaft 3 in the present embodiment is described with reference to FIGS. 8A and 8B. FIGS. 8A and 8B are cross-sectional views of a process of inserting the shaft into the rotating body.

As illustrated in FIG. 8A, the rotating body 2 is fitted into the end of the shaft 3 and the rotating body 2 is relatively pushed in a direction indicated by arrow D1 so that the hooks 44 of the snap fit portion 43 of the holder portion 14 contact an end face of the shaft 3.

From the above-described state, when the rotating body 2 is further pushed in the direction indicated by arrow D1, the hooks 44 of the snap fit portion 43 are elastically deformed, and the hooks 44 spread outward in the radial direction.

When the inner diameter of the hooks 44 spreads larger than the outer diameter of the wall portion 32 of the shaft 3, the rotating body 2 can be pushed deeper than the end face of the shaft 3.

Then, as illustrated in FIG. 8B, when the hooks 44, which have been elastically deformed, spread over the wall portion 32 and reach the position of the recess 31 of the shaft 3, the elastically deformed shape of the hooks 44 returns to the shape prior to deformation. Accordingly, the hooks 44 of the snap fit portion 43 engage with the recess 31 of the shaft 3, and the rotating body 2 is positioned and held on the shaft 3 without any play in the thrust direction.

In such a case, the rotating body 2 is pushed into the shaft 3 with the snap fit portion 43 is locked to the hook 46 (in a closed state), thus causing the hooks 44 to be hooked to the recess 31. In addition, after the rotating body 2 is pushed into the shaft 3 with the snap fit portion 43 being open, the snap fit portion 43 is closed, thus also causing the hooks 44 to be hooked on the recess 31.

Figure 9:
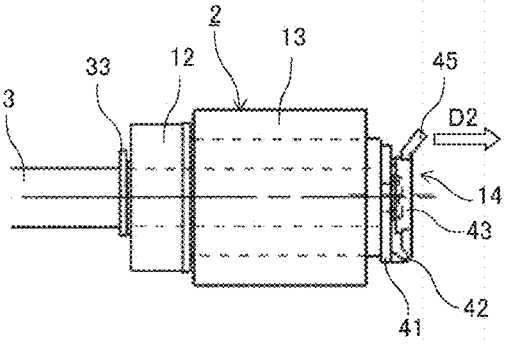
FIG. 9 is a side view of the rotating body in removal of the rotating body from the shaft.

Next, an operation in removing the rotating body 2 from the shaft 3 in the present embodiment is described with reference to FIG. 9. FIG. 9 is a side view of the operation in removing the rotating body 2 from the shaft 3 in the present embodiment.

When the rotating body 2 is removed from the shaft 3, as illustrated in FIG. 9, the knob 45 of the snap fit portion 43 is pulled outward in the axial direction indicated by arrow D2, thus causing the hooks 44 of the snap fit portion 43 to be elastically deformed and spread.

Then, when the knob 45 of the snap fit portion 43 is further pulled, as illustrated in FIG. 7B, the hooks 44 come off the recess 31, ride on the wall portion 32 on the outer side, come off the end of the shaft 3, and turn into a state illustrated in FIG. 3.

Thus, the rotating body 2 can be pulled out from the shaft 3 in the axial direction.

At this time, since the knob 45 is inclined in a direction away from the end face of the rotating body 2, the knob 45 can be easily operated.

As described above, when the snap fit portion 43 is rotated in a direction in which the hook 44 moves over the wall portion 32 on the outer side of the recess 31 in the axial direction, the snap fit portion 43 and the shaft 3 are disengaged, thus enhancing the operability and workability in removing the rotating body 2 from the shaft 3.

Figure 10:
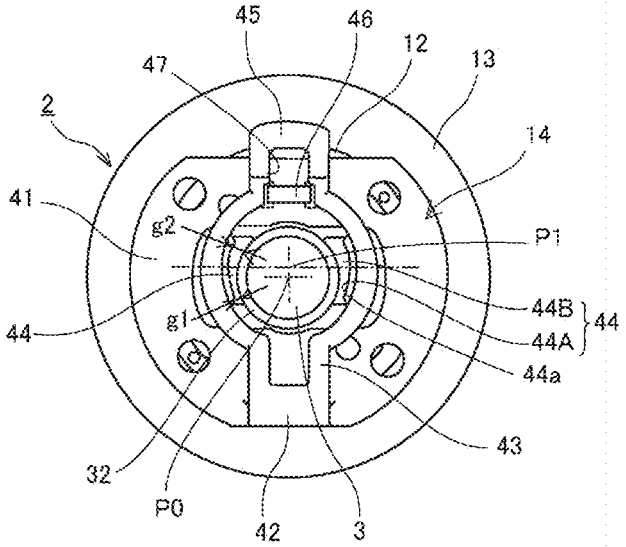
FIG. 10 is a front view of relative positions between hooks of a snap fit portion and an axis of the shaft.
Figure 11:
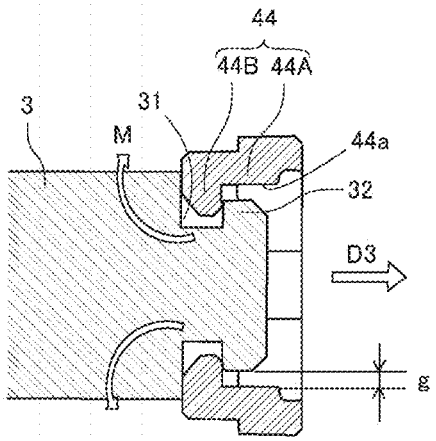
FIG. 11 is a cross-sectional view of bending moments generated by an axial force acting on the hooks.
Figure 12:
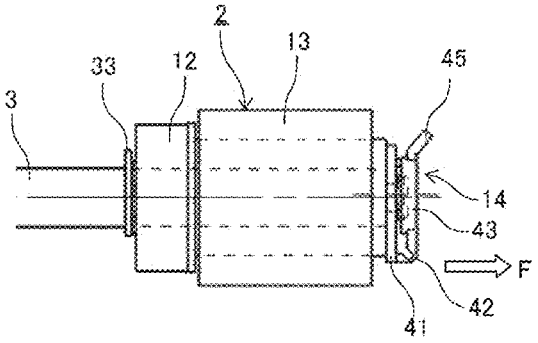
FIG. 12 is an illustration of a force acting on the snap fit portion when the rotating body is about to come off the shaft.

Next, the relative positions of the hooks 44 of the snap fit portion 43 and the axis of the shaft 3, a drop preventing action, and the ease of removal are described with reference to FIGS. 10 to 12. FIG. 10 is a front view of the relative positions of the hooks and the axis of the shaft. FIG. 11 is a cross-sectional view of a bending moment generated by an axial force acting on the hooks. FIG. 12 is an illustration of the force acting on the snap fit portion when the rotating body is about to come off the shaft.

The snap fit portion 43 has the hooks 44 at positions at which a distance L1 from the hinge 42 serving as the rotation fulcrum to a center P1 of each hook 44 is longer than a distance L0 from the hinge 42 to an axis P0 of the shaft 3 (L1>L0). That is, each hook 44 is disposed at a position closer to the knob 45 than the hinge 42.

For example, each hook 44 includes a first portion 44A and a second portion 44B. The first portion 44A extends across the wall portion 32 from the outer side in the axial direction of the shaft 3 toward the inner side (from the right side to the left side in FIG. 11) in a state in which the rotating body 2 is mounted on the shaft 3. The second portion 44B rises inward in the radial direction of the shaft 3 from the first portion 44A on the side of the recess 31 with respect to the wall portion 32. A tip of the second portion 44B enters the recess 31 and engages with the recess 31.

Here, the inner peripheral surface 44*a* of the first portion 44A of the hook 44 that faces the wall portion 32 is a curved surface centered on the center P1. Since the center P1 is offset upward from the center P0 of the shaft 3, the distance from the center P1 of the hook 44 to the outer periphery of the wall portion 32 decreases upward in FIG. 10.

With such a configuration, regarding a gap g between the first portion 44A of each hook 44 of the snap fit portion 43 and the wall portion 32 of the shaft 3, a gap g2 on a knob side of the first portion 44A of the hook 44, which is a side closer to the knob 45 than the hinge 42, is wider than a gap g1 on a hinge side of the first portion 44A of the hook 44, which is a side closer to the hinge 42 than the knob 45 (g2>g1).

As illustrated in FIG. 11, when the axial force indicated by arrow D3 acts on the snap fit portion 43, a bending moment M acting outward (radially outward) is generated in the hook 44.

At this time, the magnitude of the bending moment M increases as the gap g between the hook 44 of the snap fit portion 43 and the wall portion 32 of the shaft 3 increases. As the bending moment M increases, the hook 44 is more easily deformed. On the other hand, when the gap g between the hook 44 of the snap fit portion 43 and the wall portion 32 of the shaft 3 is narrow, the hook 44 is less easily deformed.

Therefore, on the side of the hinge 42 (with the gap g1) on which the gap g between the first portion 44A of the hook 44 and the wall portion 32 of the shaft 3 is narrow, the hook 44 is less easily deformed. Since a larger force is needed for the second portion 44B to move over the wall portion 32, the rotating body 2 less easily comes off.

On the other hand, on the side of the knob 45 (with the gap g2) on which the gap g between the first portion 44A of the hook 44 and the wall portion 32 is wide, the hook 44 is easily deformed, thus reducing the axial force needed for the second portion 44B to move over the wall portion 32. Therefore, the operation force of the knob 45 can be reduced and the snap fit portion 43 can be easily removed.

As illustrated in FIG. 12, the force F acting when the rotating body 2 is about to come off the shaft 3 is transmitted to the snap fit portion 43 via the hinge 42. Accordingly, on the side of the hinge 42, the force needed for the rotating body 2 to come off the shaft 3 increases, thus preventing the rotating body 2 from coming off the shaft 3.

In the above-described embodiment, the attachment portion 41 is provided separately from the roller holding portion 12 so that the snap fit portion (holding portion, retaining portion) can be rotated using the hinge. When the snap fit portion (holding portion, retaining portion) is directly provided on the roller holding portion 12 or the rotating body 2 so as to be rotatable, the attachment portion can be obviated. Alternatively, in the snap fit portion (holding portion, retaining portion), a support shaft holding portion may be formed on the rotating body or a constituent member of the rotating body. In such a case, the snap fit portion can be rotatably held by a support shaft attached to the support shaft holding portion.

Figure 13:
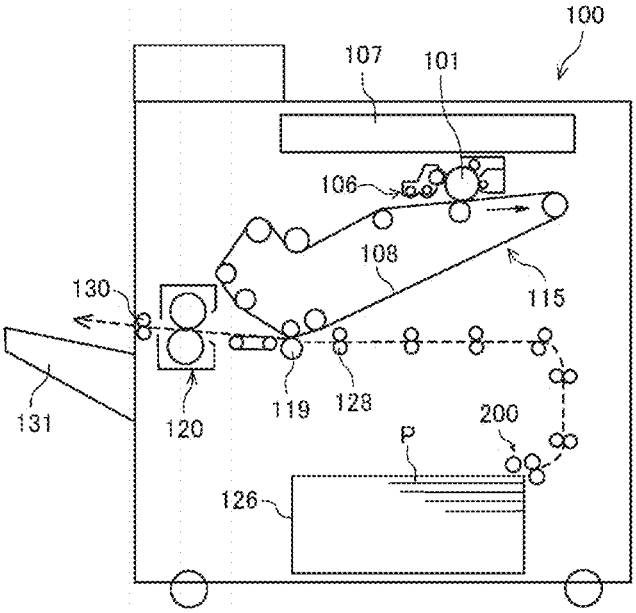
FIG. 13 is an illustration of an overall configuration of an example of an image forming apparatus as an apparatus according to an embodiment of the present invention.
Figure 14:
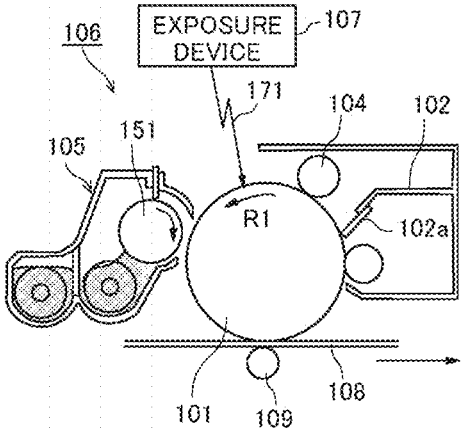
FIG. 14 is an illustration of an image forming unit of the image forming apparatus.
Figure 15:
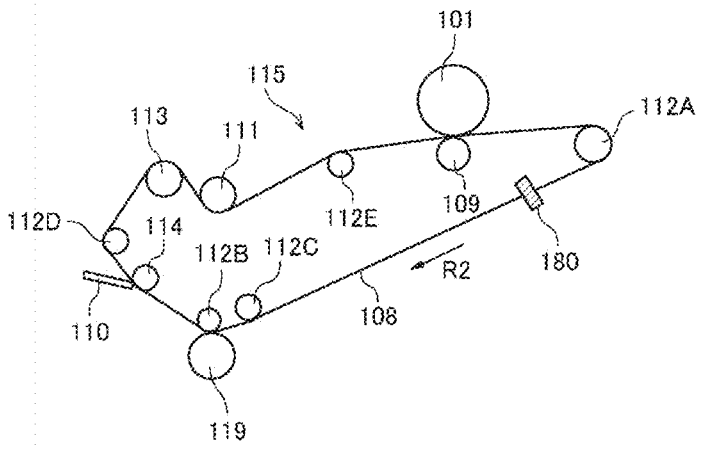
FIG. 15 is an illustration of an intermediate transfer unit of the image forming apparatus.

Next, an example of an image forming apparatus as an apparatus including the rotating member including the rotating body according to an embodiment of the present invention is described with reference to FIGS. 13 and 14. FIG. 13 is a schematic view of an overall configuration of the image forming apparatus according to an embodiment of the present invention. FIG. 14 is a schematic view of an image forming unit of the image forming apparatus. FIG. 15 is a schematic view of an intermediate transfer unit of the image forming apparatus.

An image forming apparatus according to the present embodiment includes an intermediate transfer belt unit 115 in the middle of an apparatus body 100. An image forming unit 106 including one process cartridge corresponding to black color (black) is detachably attached so as to face an intermediate transfer belt 108 of the intermediate transfer belt unit 115.

As illustrated in FIG. 14, the image forming unit 106 includes, for example, a photoconductive drum 101 as an image bearer, a charging unit 104 disposed around the photoconductive drum 101, a developing unit 105, a cleaning unit 102, a charge eliminating unit, and the like.

When an image forming process including a charging process, an exposure process, a developing process, a transfer process, and a cleaning process is performed on the photoconductive drum 101, an image (toner image) is formed on the photoconductive drum 101.

The photoconductive drum 101 is driven by a drive motor to rotate in a counter-clockwise direction indicated by arrow R1 in FIG. 14. A surface of the photoconductive drum 101 is uniformly charged at the position of the charging unit 104 (charging process). The charging unit 104 may be either a contact charging type or a non-contact charging type. Thereafter, the surface of the photoconductive drum 101 reaches an irradiation position of a laser light 171 emitted from an exposure unit 107, and an electrostatic latent image is formed by exposure scanning at the irradiation position (exposure process).

Thereafter, the surface of the photoconductive drum 101 reaches a position facing the developing unit 105 and toner is supplied from a developing roller 151 at the position facing the developing unit 105. Thus, the electrostatic latent image is developed and visualized as a toner image (development process).

Thereafter, the surface of the photoconductive drum 101 reaches a position at which the intermediate transfer belt 108 and a primary transfer roller 109 face each other, and the toner image on the photoconductive drum 101 is transferred onto the intermediate transfer belt 108 at the position at which the intermediate transfer belt 108 and the primary transfer roller 109 face each other (primary transfer process). At this time, a slight amount of untransferred toner remains on the photoconductive drum 101.

Thereafter, the surface of the photoconductive drum 101 reaches a position facing the cleaning unit 102, and untransferred toner remaining on the photoconductive drum 101 at the position facing the cleaning unit 102 is collected into the cleaning unit 102 by a cleaning blade 102*a* (cleaning process).

Finally, the surface of the photoconductive drum 101 reaches a position facing the charge eliminating unit, and a residual potential on the photoconductive drum 101 is removed at the position facing the charge eliminating unit.

Thus, a series of image forming processes performed on the photoconductive drum 101 is completed.

As illustrated in FIG. 15, the intermediate transfer belt unit 115 includes an intermediate transfer belt 108. The intermediate transfer belt 108 is stretched and supported by the primary transfer roller 109, a driving roller 112A, a secondary transfer counter roller 112B, three tension rollers 112C to 112E, a correction roller 113, an outer-peripheral-side tension roller 111, and a cleaning counter roller 114. The intermediate transfer belt 108 rotates around by the rotational driving of the driving roller 112A. The intermediate transfer belt unit 115 includes, for example, a detection unit 180 and an intermediate transfer cleaning unit 110.

The intermediate transfer belt 108 travels in a direction indicated by arrow R2, and the toner image on the photoconductive drum 101 is primarily transferred at the position of a primary transfer nip of the primary transfer roller 109.

Thereafter, the intermediate transfer belt 108 onto which the toner image has been primarily transferred reaches a position facing a secondary transfer roller 119 as a secondary transfer member. At the position facing the secondary transfer roller 119, the secondary transfer counter roller 112B sandwiches the intermediate transfer belt 108 with the secondary transfer roller 119 to form a secondary transfer nip.

The toner image formed on the intermediate transfer belt 108 is transferred onto a sheet material P, such as transfer sheet of paper, conveyed to the position of the secondary transfer nip.

Here, the sheet material P is fed by a feeding device 200 from a sheet feeding unit 126 disposed in a lower portion of the apparatus body 100 and is conveyed through a registration roller pair 128 and the like.

A plurality of sheet materials P, such as transfer sheets of paper, is stored in the sheet feeding unit 126 in a stacked manner. An uppermost sheet material P is fed toward the registration roller pair 128 by the feeding device 200.

The sheet material P conveyed to the registration roller pair 128 (timing roller pair) temporarily stops at a position of a roller nip of the registration roller pair 128 that has been stopped rotating. The registration roller pair 128 is rotated so that the sheet material P is conveyed to the secondary transfer nip in synchronization with the image on the intermediate transfer belt 108. Thus, a desired image is transferred on the sheet material P at the secondary transfer nip.

The sheet material P on which the image has been transferred at the secondary transfer nip is conveyed to the fixing unit 120. In the fixing unit 120, the image transferred on the surface of the sheet material P is fixed on the sheet material P under heat and pressure generated by a fixing roller and a pressure roller.

The sheet material P is ejected out of the apparatus body 100 by an ejection roller pair 130 and sequentially stacked on a stacker 131.

Figure 16:
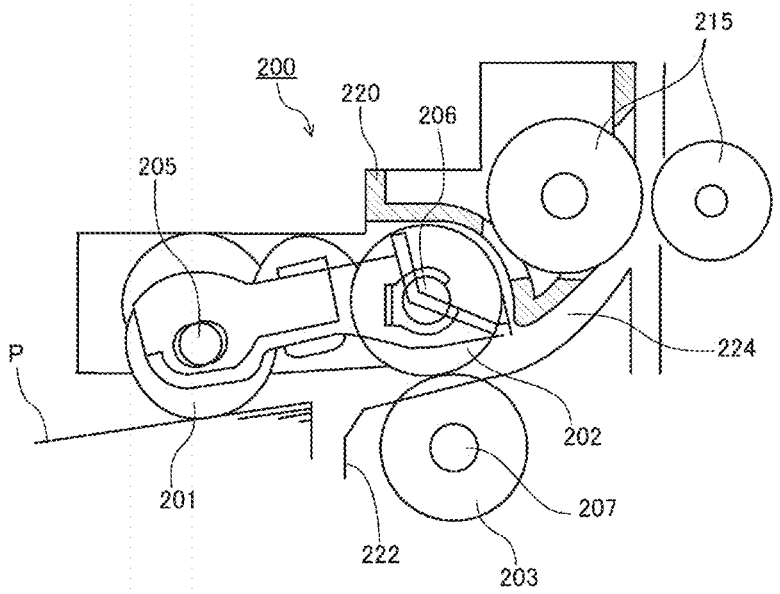
FIG. 16 is an illustration of an example of a feeding device.

Next, an example of the feeding device 200 is described with reference to FIG. 16. FIG. 16 is a schematic view of an example of the feeding device.

The feeding device 200 includes a pickup roller 201 that picks up the sheet material P. A feed roller 202 and a separation roller 203 that is in pressure contact with the feed roller 202 are disposed downstream from the pickup roller 201 in a sheet feed direction in which the sheet material P is fed. A conveyance roller pair 215 is disposed downstream from the feed roller 202 in the sheet feed direction.

Each of the pickup roller 201, the feed roller 202, and the separation roller 203 is a rotating body or a member to be inserted with a shaft. A fixed shaft 205 is inserted into the pickup roller 201. A shaft 206 serving as a drive shaft is inserted into the feed roller 202. A shaft 207 serving as a drive shaft is inserted into the separation roller 203.

The pickup roller 201 sends out the sheet material P placed on a tray of the sheet feeding unit 126 to a downstream side in the sheet feed direction. The one or more sheet materials P fed by the pickup roller 201 reach between the feed roller 202 and the separation roller 203. The sheet is separated one by one by the feed roller 202 and the separation roller 203 and sent to a conveyance path 224 formed by a conveyance guide 222 and a housing 220.

That is, the feed roller 202 is driven to rotate in a direction of feeding the sheet material P downstream, while the separation roller 203 is rotated via a torque limiter in a direction opposite the direction of rotation of the feed roller 202, in other words, a direction of returning the sheet material P upstream.

When no sheet material P is between the feed roller 202 and the separation roller 203, the feed roller 202 is driven to rotate in the direction of feeding the sheet material P downstream. A driving force is transmitted from the feed roller 202 to the separation roller 203, and the separation roller 203 rotates with the feed roller 202 by the torque limiter.

When only one sheet material P is sandwiched between the feed roller 202 and the separation roller 203, the sheet material P is sent to the downstream side by the rotational drive of the feed roller 202. At this time, the driving force is transmitted from the feed roller 202 to the separation roller 203 via one sheet material P, and the separation roller 203 rotates with the feed roller 202 by the torque limiter.

On the other hand, when a plurality of sheet materials P is sandwiched between the feed roller 202 and the separation roller 203, the sheet materials P slide with each other, so that only the sheet material P contacting the feed roller 202 is fed downstream by the driving force of the feed roller 202. The other sheet materials P are sequentially returned upstream as the separation roller 203 rotates in the direction of returning the sheet materials P.

Thus, the plurality of sheet materials P can be sent one by one without being sent together.

Figure 17:
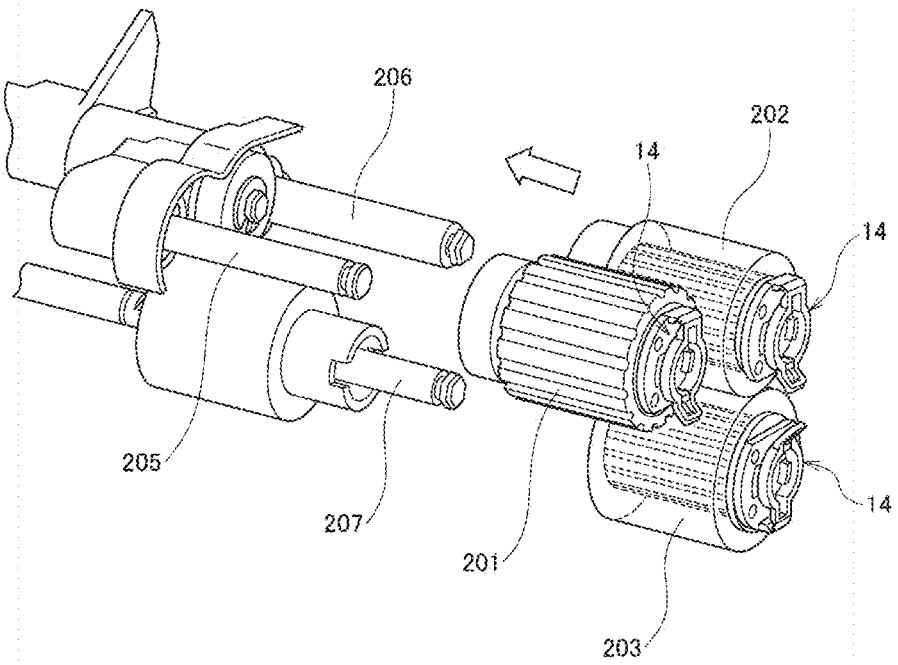
FIG. 17 is a perspective view of a roller section in installation of rollers of the feeding device to shafts.
Figure 18:
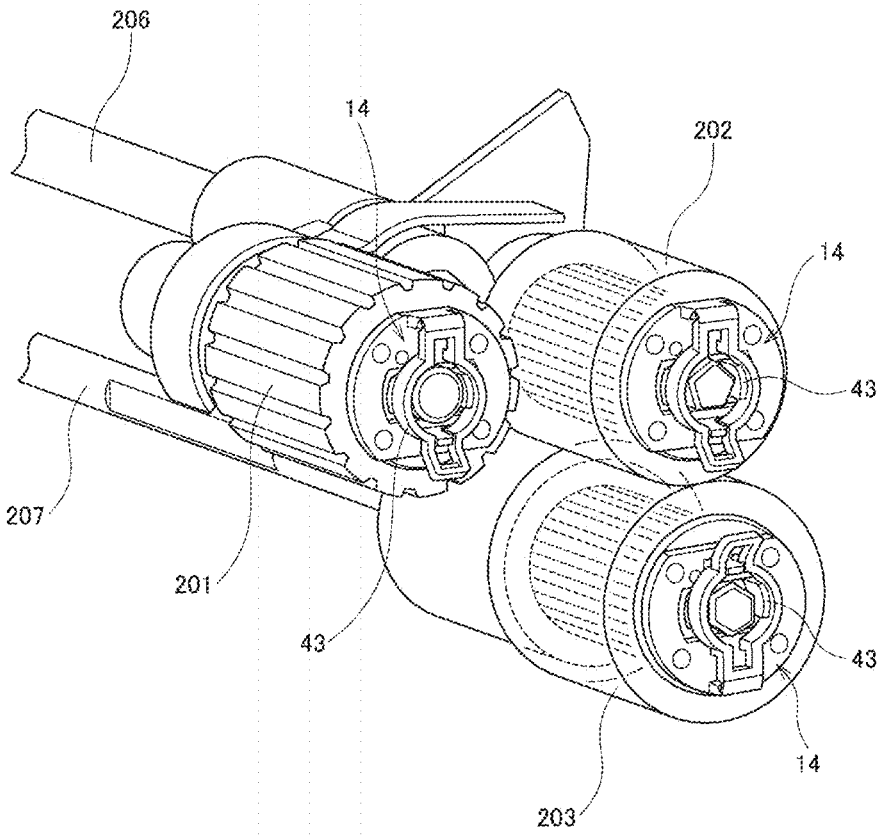
FIG. 18 is a perspective view of the roller section in a state in which the rollers are mounted on the shafts.
Figure 19:
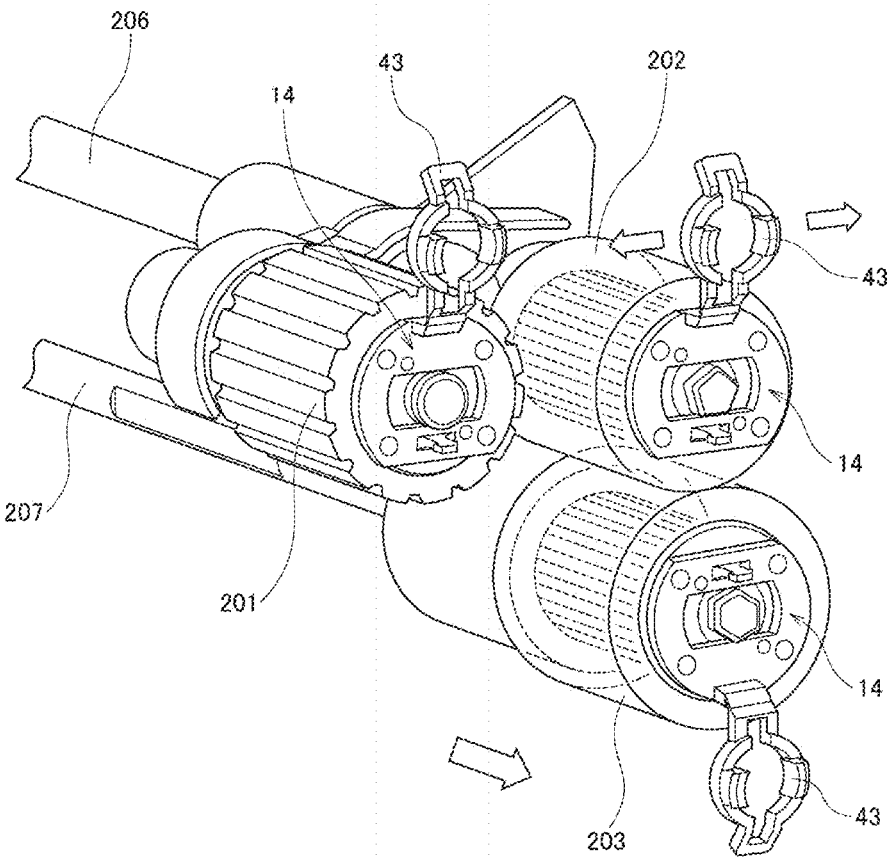
FIG. 19 is a perspective view of the roller section in removal of the rollers from the shafts.

Next, the three rollers of the feeding device are described with reference to FIGS. 17 to 19. FIG. 17 is a perspective view of a roller section in installation of the pickup roller, the feed roller, and the separation roller to the shafts. FIG. 18 is a perspective view of the roller section in a state in which the pickup roller, the feed roller, and the separation roller are mounted on the shafts. FIG. 19 is a perspective view of the roller section in removal of the pickup roller, the feed roller, and the separation roller from the shafts.

As described above, each of the pickup roller 201, the feed roller 202, and the separation roller 203 is a rotating body or a member to be inserted with a shaft. Each of the pickup roller 201, the feed roller 202, and the separation roller 203 has an end face with the holder portion 14 including the snap fit portion 43 and so on of the first embodiment.

As illustrated in FIG. 17, the pickup roller 201 is fitted on the shaft 205 and is held at an end portion of the shaft 205 by the snap fit portion 43 of the holder portion 14 as illustrated in FIG. 18. Similarly, the feed roller 202 is fitted on the shaft 206 and the separation roller 203 is fitted on the shaft 207 and is held at an end portion of the shaft 207 by the snap fit portion 43 of the holder portion 14 as illustrated in FIG. 18.

When the pickup roller 201 is replaced, as illustrated in FIG. 19, the snap fit portion 43 is operated to disengage the recess 31 and the hook 44 and the pickup roller 201 is pulled out from the shaft 205. The new pickup roller 201 is fitted on the shaft 205 and is held at an end portion of the shaft 205 by the snap fit portion 43 of the holder portion 14 as illustrated in FIG. 18. The same operation can be performed when the feed roller 202 and the separation roller 203 are replaced.

The rotating body may be, for example, a roller (feed roller) related to sheet feeding such as each roller of the feeding device, as well as a conveyance roller, a discharge roller, a fixing roller, a transfer roller, a charging roller, a coating roller, and a roller supporting a belt. For example, when a guide member is held by a shaft, an embodiment of the present invention can be applied to the guide member as a member to be inserted with the shaft.

This patent application is based on and claims priority pursuant to 35 U.S.C. § 119(a) to Japanese Patent Application Nos. 2019-002269, filed on Jan. 10, 2019, and 2019-003914, filed on Jan. 12, 2019, in the Japan Patent Office, the entire disclosure of each of which is hereby incorporated by reference herein.

REFERENCE SIGNS LIST

1 Rotation member
2 Rotating body
3 Shaft
12 Roller holder
13 Roller portion
14 Holder portion (retaining member)
31 Recessed portion
32 Wall portion
41 Attachment portion
42 Hinge
43 Snap fit portion (holding portion, retaining portion)
44 Hook
45 Knob
46 Hook
100 Apparatus body of Image forming apparatus
200 Feeding device
201 Pickup roller
202 Sheet feed roller
203 Separation roller
205, 206, 207 Shafts

The invention claimed is:

1. A rotating body to be inserted with a shaft, comprising:
a holding portion on an end portion of the rotating body to hold the rotating body on the shaft,
the holding portion including a hook, pivotally movable to an interior space of the holding portion, to be elastically deformable and detachably hook on a recess of an end portion of the shaft,
the holding portion being rotatingly movable, with elastic deformation of the hook, over a convex portion of the shaft that is outside the recess in an axial direction of the shaft.

2. The rotating body according to claim 1, wherein the hook has a claw shape.

3. The rotating body according to claim 2, further comprising:
an attachment portion on an end face of the rotating body; and
a hinge on the attachment portion and rotatably holding the holding portion.

4. The rotating body according to claim 1, further comprising:
an attachment portion on an end face of the rotating body; and
a hinge on the attachment portion and rotatably holding the holding portion.

5. The rotating body according to claim 4, wherein the attachment portion includes a hook to detachably engage a side of the holding portion opposite to a rotation fulcrum of the holding portion.

6. The rotating body according to claim 5, further comprising:
a hollow member to be inserted with the shaft; and
an outer peripheral member on an outer peripheral surface of the hollow member,
wherein the attachment portion is on the hollow member.

7. The rotating body according to claim 6, wherein
the attachment portion includes a plurality of holes fitted with projections of on the hollow member, and
the plurality of holes includes holes that are different in hole diameters and distances between the holes.

8. The rotating body according to claim 4, further comprising:
a hollow member to be inserted with the shaft; and
an outer peripheral member on an outer peripheral surface of the hollow member,
wherein the attachment portion is on the hollow member.

9. The rotating body according to claim 8, wherein
the attachment portion includes a plurality of holes fitted with projections of the hollow member, and
the plurality of holes includes holes that are different in hole diameters and distances between the holes.

10. The rotating body according to claim 1, wherein a distance between a rotation fulcrum of the holding portion and a center of the hook is greater than a distance from the rotation fulcrum to a center of a hole into which the shaft is inserted.

11. The rotating body according to claim 1, wherein the holding portion includes a knob on a side opposite to a rotation fulcrum of the holding portion across the hook.

12. The rotating body according to claim 11, wherein the knob is different in color from another portion of the rotating body.

13. The rotating body according to claim 11, wherein the knob is obliquely disposed in a direction away from an end face of the rotating body.

14. The rotating body according to claim 1, wherein the holding portion includes a plurality of hooks including the hook.

15. The rotating body according to claim 1, wherein the rotating body is one of:
a feeding roller to feed a sheet;
a conveyance roller to convey a sheet;
an ejection roller to eject a sheet;
a fixing roller to fix an image on a sheet;
a transfer roller to transfer an image to a transfer target object;
a charging roller to charge a charging target object;
a coating roller to coat a sheet with a coating agent; or
a roller supporting a belt.

16. An apparatus comprising the rotating body according to claim 1.

17. A member to be inserted with a shaft, the member comprising:

a holding portion on an end portion of the member to hold the member on the shaft, the holding portion including a hook, pivotally movable to an interior space of the holding portion, to be elastically deformable and detachably hook on a recess of an end portion of the shaft, the holding portion being rotatingly movable, with elastic deformation of the hook, over a convex portion of the shaft that is outside the recess in an axial direction of the shaft.

18. An apparatus comprising the member according to claim 17 to be inserted with the shaft.

19. A retaining member configured to be attached to an end portion of a member to be inserted with a shaft, the retaining member comprising:

an attachment portion to be attached on the member to be inserted with the shaft; and a retaining portion rotatably attached to the attachment portion, the retaining portion including a hook, pivotally movable to an interior space of the attachment portion, to be elastically deformable and detachably hook on a recess of an end portion of the shaft, the retaining portion being rotatingly movable, with elastic deformation of the hook, over a convex portion of the shaft that is outside the recess in an axial direction of the shaft.

20. An apparatus comprising the retaining member according to claim 19.

* * * * *